US009456667B2

(12) United States Patent
Bixby

(10) Patent No.: US 9,456,667 B2
(45) Date of Patent: Oct. 4, 2016

(54) JEWELRY ENHANCER

(76) Inventor: Barbara Bixby, Dover Plains, NY (US)

( * ) Notice: Subject to any disclaimer, the term of this patent is extended or adjusted under 35 U.S.C. 154(b) by 0 days.

(21) Appl. No.: 13/589,466

(22) Filed: Aug. 20, 2012

(65) Prior Publication Data

US 2014/0047865 A1 Feb. 20, 2014

(51) Int. Cl.
*A44C 5/20* (2006.01)
*A44C 15/00* (2006.01)

(52) U.S. Cl.
CPC ..... *A44C 5/2009* (2013.01); *A44C 15/005* (2013.01)

(58) Field of Classification Search
CPC .... A44C 9/0046; A44C 7/002; A44C 13/00; A44C 15/0055; A44C 5/2009; A44C 9/0038; A44C 15/005
USPC ..... 63/3, 3.2, 4, 21, 7, 15.7, 8, 9; D10/36
See application file for complete search history.

(56) References Cited

U.S. PATENT DOCUMENTS

D31,064 S * 6/1899 Mirabeau ..... D11/2
2,521,589 A * 9/1950 Livingston ..... 63/20
3,098,364 A * 7/1963 Verri ..... 63/1.16
3,844,458 A * 10/1974 Lanvin ..... G04B 37/1486 224/170
4,815,180 A * 3/1989 Elsener ..... 24/616
D351,565 S * 10/1994 Ito ..... D10/126
5,669,242 A * 9/1997 Cayton ..... 63/21
6,718,797 B2 * 4/2004 Plumly ..... 63/18
7,024,886 B1 * 4/2006 Ito ..... 63/3
7,350,376 B2 * 4/2008 Couling ..... 63/3.1
7,513,129 B1 * 4/2009 Mays ..... 63/3.2
7,779,517 B1 * 8/2010 Stewart ..... 24/303
8,205,471 B2 * 6/2012 McLees ..... 63/3.1
2002/0078707 A1 * 6/2002 Walker et al. ..... 63/3.2
2004/0007017 A1 * 1/2004 Flaherty ..... 63/3.1
2008/0041098 A1 * 2/2008 Lafauci et al. ..... 63/3
2011/0067446 A1 * 3/2011 McLees ..... 63/3.2

* cited by examiner

*Primary Examiner* — Abigail Morrell
(74) *Attorney, Agent, or Firm* — Levisohn Berger LLP

(57) ABSTRACT

An enhancer for jewelry necklaces in which the enhancer is connected to lower ends of an upper strand and allows a plurality of lower strands to be attached to each respective enhancer so as to allow the consumer to provide a plurality of ornamental appearances for the resulting necklace structure. An alternative embodiment uses a single enhancer for allowing a plurality of decorative elements such as charms to be added to a necklace.

3 Claims, 4 Drawing Sheets

JEWELRY ENHANCER

BACKGROUND OF THE INVENTION

This invention relates to jewelry necklaces, and more particularly, to an enhancer for providing the consumer the ability to easily alter the overall look and appearance of a necklace.

Jewelry necklaces comprising strands are a long time staple in the industry. Consumers are provided with a wide variety of choices, and many consumers have a number of different necklaces.

Prior art necklaces are not variable in appearance, and users have to change necklaces when different appearances are desired.

An object of this invention is to provide an improved jewelry necklace structure in which the appearance and structure of the necklace may be easily changed by the consumer.

Another object of this invention is to provide such a jewelry necklace susceptible of different ornamental appearances depending upon the user's needs and desires.

Still another object of this invention is to provide such an enhancer which is capable of widespread use and easy manufacturing.

Yet another object of this invention is to provide an adaptable, fundamental jewelry element which may be utilized to provide different looks.

Still another object of this invention is to provide a necklace in which decorative elements may be easily added to enhance the ornamental appearance of the necklace.

Other objects, advantages and features of this invention will become more apparent from the following description.

SUMMARY OF THE INVENTION

In accordance with the principles of this invention, the above objects are accomplished by providing a jewelry necklace comprising upper and lower strands with the ends of the upper strand connectible to a jewelry enhancer which is in the form of a ring or loop, itself perhaps of ornamental design, and having a catch or opening allowing a lower strand to be attached at each end of the upper strand. The enhancers can hold a plurality of lower strands, each of which may be of the same design or of different designs from other of the lower strands to create a unique necklace look in which the upper strand is singular and the lower strand section comprises a plurality of different strands.

The enhancers may be attached to the ends of the upper strand in a relatively fixed manner or may be easily removed from the ends of the upper strands, as desired. Additionally, the length of the necklace may be adjusted by changing the upper strand to provide a longer upper strand thereby lengthening the overall appearance of the necklace.

The enhancer may be ring shaped, rounded or somewhat square, all of which are within the teaching of the invention, and a catch allowing an opening to be formed in the enhancer allows for easily changing ornamental lower strands as desired.

The enhancer of this invention is easily manually manipulated in a fairly conventional manner so that the consumer can change the ornamental appearance of the necklace as desired to provide a multitude of different looks as desired.

An alternative embodiment of this invention is to provide a single enhancer which would be used with a single strand to close the strand to form the necklace, the enhancer, itself, having a catch allows decorative elements, such as charms and pendants, to be hung therefrom on the enhancer and necklace.

The enhancer element could therefore be used in combination with a single upper strand to form a single necklace, or a pair of enhancers can be used in combination with an upper strand and a plurality of lower strands, thereby providing a wide variety of ornamental appearances for the necklace and enhancer structure of this invention.

In essence, the enhancers of either embodiment may be opened to allow strands or decorative elements to be added or removed from said enhancers to change the ornamental appearance of a necklace.

If a single enhancer is used with a single strand, it may be substantially permanently attached to the necklace so as to facilitate easy changing of decorative elements on the enhancer to alter the ornamental appearance of the resulting jewelry necklace structure.

DETAILED DESCRIPTION OF THE PREFERRED EMBODIMENT

Figure 1:
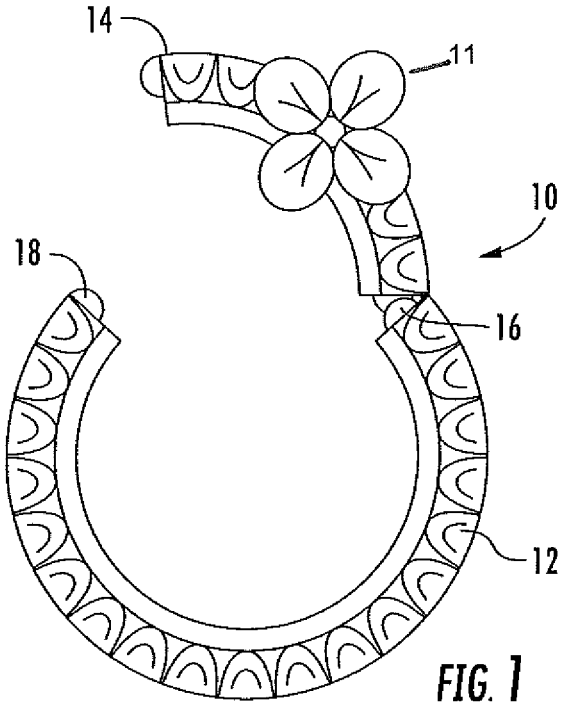
FIG. 1 is a top plan view of the enhancer in open form.
Figure 2:
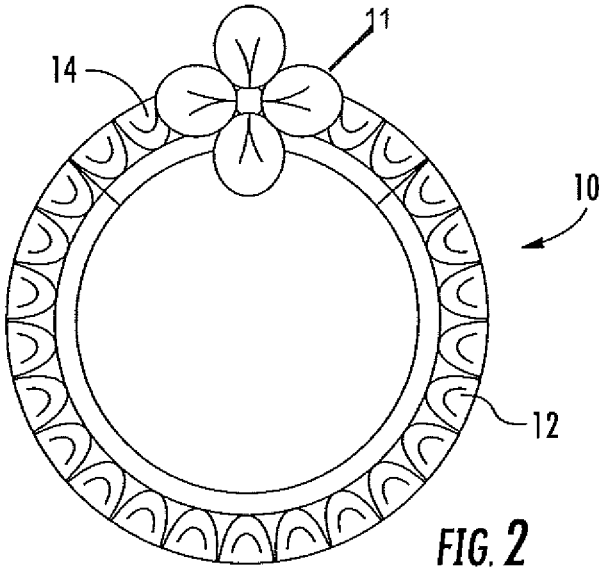
FIG. 2 is a top plan view of the enhancer when closed.

FIGS. 1 and 2 show an enhancer 10 of this invention, which is comprised of two sections 12 and 14 and a hinge 16 so that section 14 closes into section 12 to form a closed loop or ring. An additional decorative element 11 is shown as part of section 14. A conventional catch 18 is employed to firmly close enhancer 10. This invention provides a unique and novel necklace structure in which the enhancer 10 shown in FIGS. 1 and 2 is used with upper and lower strands.

Figure 3:
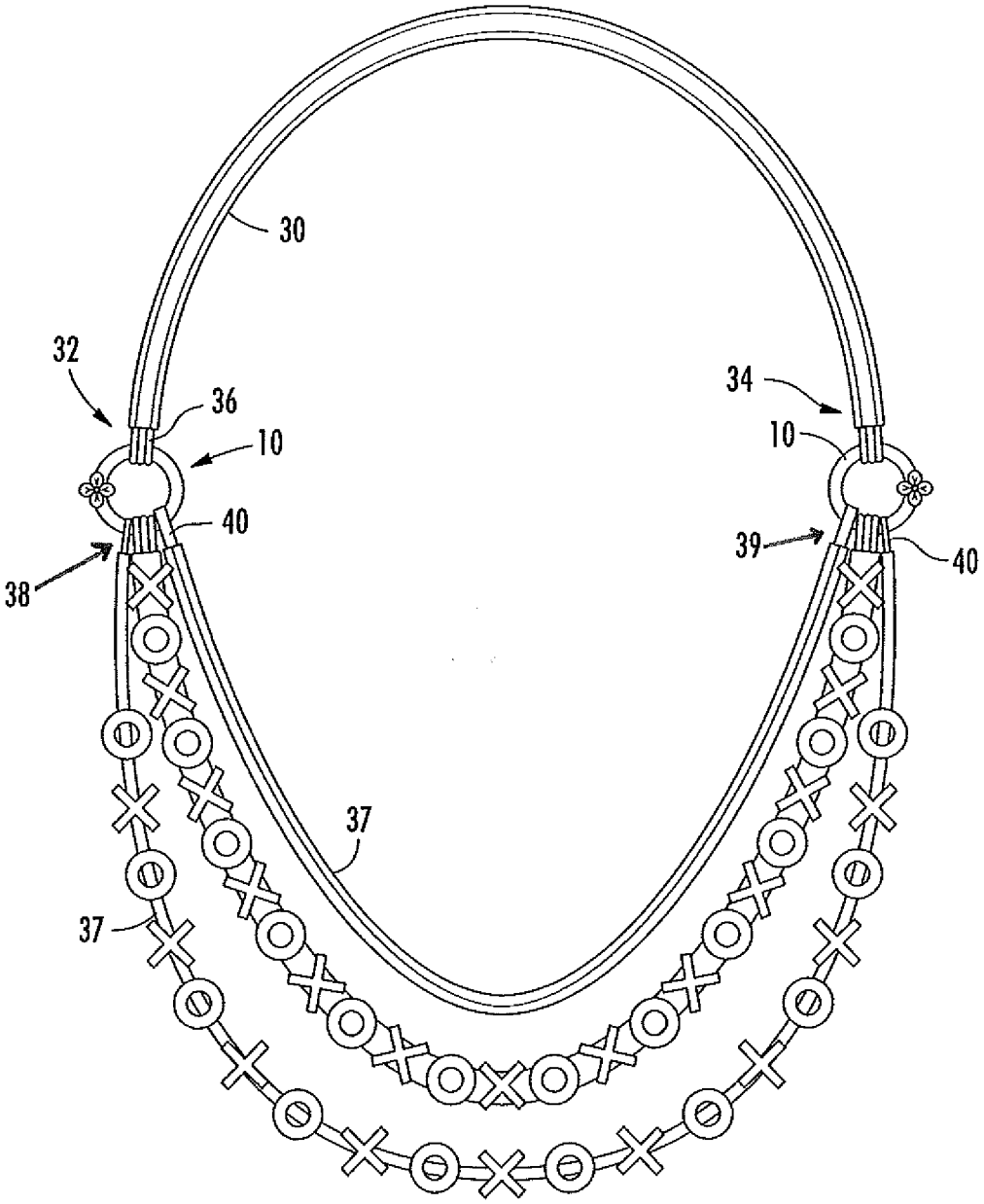
FIG. 3 is a top plan view of a necklace employing two such enhancers with a plurality of lower strands and a single upper strand.

FIG. 3 illustrates one embodiment of this invention in which upper strand 30 has ends 32 and 34 which are connected to enhancer 10. Enhancer 10 may be substantially fixedly connected at the ends 32 and 34 or may have loops 36 at the ends through which enhancers 10 are slid.

Enhancer 10 has section 14 which can be opened to allow a plurality of lower strands 37 to be attached at each end 38 and 39, respectively through respective enhancers 10 to allow the consumer to change the appearance of the resulting necklace, as desired. Each of the lower strands comprises a loop 40 which is large enough to be slid onto enhancer 10 when enhancer 10 is in the open position.

It may be understood that the upper strand 30, itself, may be changed so as to lengthen the necklace by changing one upper strand for another. While a plurality of different upper strands could be utilized concurrently, the common utilization of this invention with enhancers 10 will be to allow the consumer to alter the lower strand look by connecting a plurality of strands, each of which may be different from, similar to or the same as other of the lower strands. The lower strands connected to the enhancer may be one or a plurality of such strands as desired by the user.

Figure 4:
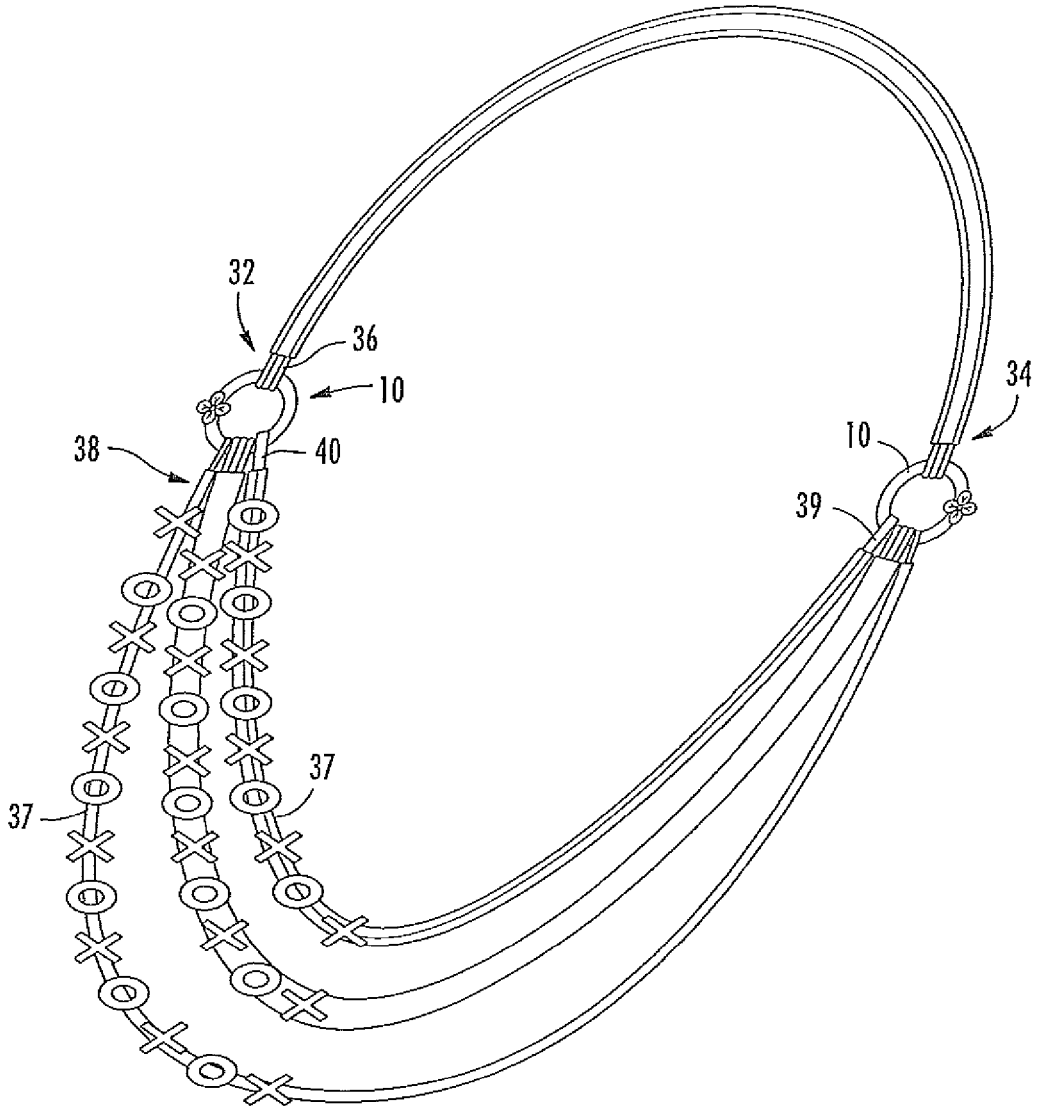
FIG. 4 is a top plan view of a necklace having an asymmetric aesthetic achievable with the present invention.

Additionally, the lower strands may be asymmetric to provide a more avant guard appearance. This is shown in FIG. 4 . . . .

Figure 5:
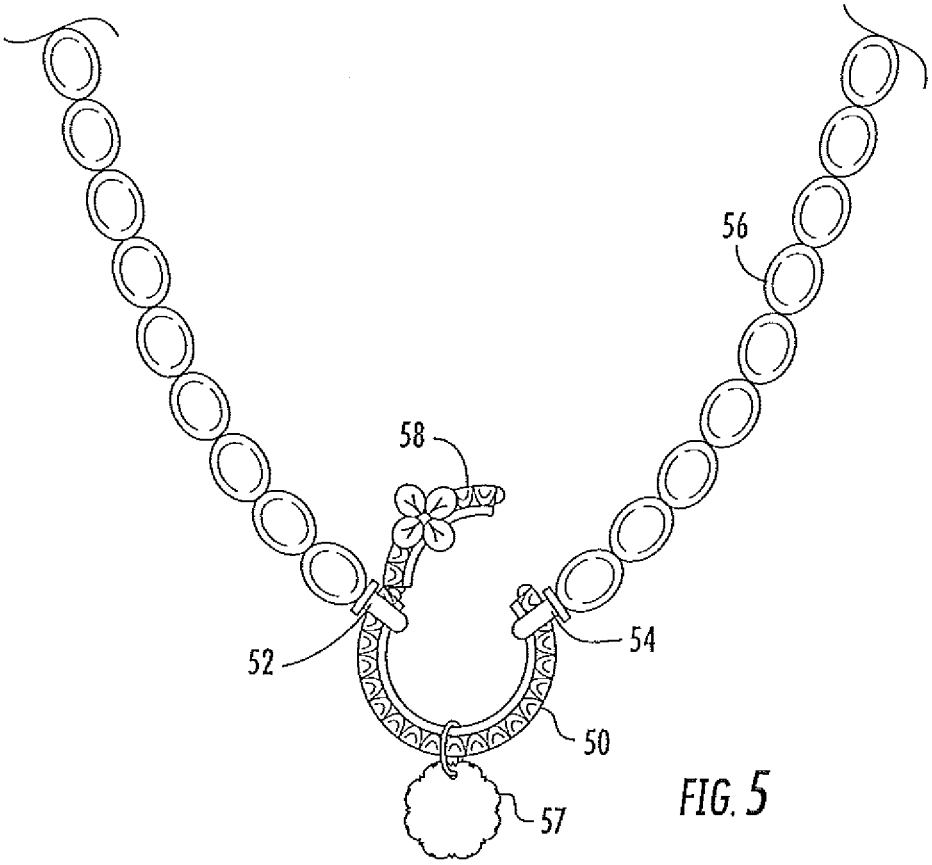
FIG. 5 is a top plan view of an alternate embodiment of this invention employing a single enhancer with a single necklace strand.

FIG. 5 is a top view of another embodiment of this invention in which a single enhancer is used with a single strand to form a necklace. In this embodiment, a single enhancer 50 is connected to lower ends 52 and 54 of strand 56. Prior to connecting the enhance 50 to the lower ends 52 and 54 of the upper strand 56, a plurality of decorative elements, such as charms or pendants 57, may be slid onto the enhancer, thereby depending downwardly from the enhancer when the necklace strand is worn as a single strand necklace. A plurality of strands could be connected in place of the single strand 56 to provide a further variation in ornamental appearance of the invention through use of enhancer 50.

The catch 58 which opens and closes enhancer 50 is shown above the lower ends 52 and 54 of strand 56. In that embodiment, the enhancer can not be permanently attached to the ends 52 and 54, but if the catch 58 is in the lower portion of enhancer 50, the enhancer could be permanently attached to the lower ends 52 and 54 of strand 58, and the consumer could easily open the catch, allowing different decorative elements to be added to the enhancer.

The preferred embodiment is as shown in FIG. 5 in which the catch 58 is located above the lower ends 52 and 54 of strand 56.

It should be understood that the preferred embodiment was described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly legally and equitably entitled.

The invention claimed is:

1. A jewelry product enhancer for use with interchangeable decorative jewelry items to create consumer designed jewelry, said jewelry product enhancer comprising:

a ring structure comprising two sections connected by a hinge permitting said ring structure to be open to receive said decorative jewelry items, said ring structure having concentric, smooth inner and outer surfaces, a catch attached to said ring structure and located between said inner and outer surfaces, said catch being hidden when said ring structure is closed, said two sections comprising an upper section and a lower section with said upper section being smaller than said lower section, said hinge and said catch connecting said upper and lower sections, said upper section opening upwardly to create a space to allow said decorative jewelry items to slide on said smooth inner surface or remove said decorative jewelry items from said lower section, said ring structure comprising an ornamental appearance, said ring structure further comprising an independent decorative element fixedly attached to said ring structure, said independent decorative element attached to said upper section and being larger than the distance between said inner and outer surfaces, said independent decorative element extending inwardly from said inner surface and outwardly from said outer surface, said independent decorative element located above and proximate to said catch, facilitating opening and closing said catch.

2. The jewelry product enhancer as set forth in claim 1, wherein said independent decorative element is a floral design.

3. The jewelry product enhancer as set forth in claim 1, wherein said independent decorative element is attached to the top of said ring structure.

* * * * *